US012330836B2

(12) United States Patent
Defert et al.

(10) Patent No.: US 12,330,836 B2
(45) Date of Patent: Jun. 17, 2025

(54) TUBE CLOSURE ASSEMBLY AND TUBE COMPRISING THE SAME

(71) Applicant: ALBEA SERVICES, Gennevilliers (FR)

(72) Inventors: Sylvain Defert, Gennevilliers (FR); Franck Fritsch, Gennevilliers (FR); Louis Miette, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 714 days.

(21) Appl. No.: 17/617,239

(22) PCT Filed: Jun. 3, 2020

(86) PCT No.: PCT/EP2020/065393

§ 371 (c)(1),
(2) Date: Dec. 7, 2021

(87) PCT Pub. No.: WO2020/245227

PCT Pub. Date: Dec. 10, 2020

(65) Prior Publication Data

US 2022/0234799 A1 Jul. 28, 2022

(30) Foreign Application Priority Data

Jun. 7, 2019 (FR) ..... 1906117

(51) Int. Cl.
*B65D 17/44* (2006.01)
*B65D 35/44* (2006.01)
(Continued)

(52) U.S. Cl.
CPC ..... *B65D 17/44* (2018.01); *B65D 35/44* (2013.01); *B65D 41/0471* (2013.01);
(Continued)

(58) Field of Classification Search
CPC .... B65D 51/222; B65D 51/224; B65D 17/44; B65D 17/42; B65D 41/0471; B65D 41/0414
See application file for complete search history.

(56) References Cited

U.S. PATENT DOCUMENTS 2,152,001 A * 3/1939 Temple ..... B65D 51/222 222/546
4,387,822 A * 6/1983 Lynn ..... B65D 41/0471 215/330

(Continued)

FOREIGN PATENT DOCUMENTS

EP 1097876 5/2001
LU 88845 6/1998

*Primary Examiner* — Nathan J Jenness
*Assistant Examiner* — Jennifer Castriotta
(74) *Attorney, Agent, or Firm* — Kilpatrick Townsend & Stockton LLP

(57) ABSTRACT

An assembly for closing a tube is described. The assembly includes a tube head provided with a neck and a lid closing the neck. The assembly further includes a cap (30) including a punch adapted to perforate the lid. The neck and the cap being configured to guide the cap to a closing position in which the punch has perforated the lid. The cap includes a lateral skirt provided with at least one notch opening radially. The neck includes a protrusion configured to cooperate angularly with the notch to block a withdrawal of the cap, once the cap is in the closing position.

10 Claims, 9 Drawing Sheets

(51) Int. Cl.

| | |
|---|---|
| ***B65D 41/04*** | (2006.01) |
| ***B65D 41/34*** | (2006.01) |
| ***B65D 50/00*** | (2006.01) |
| ***B65D 51/22*** | (2006.01) |

(52) U.S. Cl.
CPC ..... *B65D 41/34* (2013.01); *B65D 50/00* (2013.01); *B65D 51/222* (2013.01); *B65D 2251/0015* (2013.01)

(56) References Cited

U.S. PATENT DOCUMENTS

| | | | | | |
|---|---|---|---|---|---|
| 4,591,063 | A * | 5/1986 | Geiger | B65D 41/045 | 215/331 |
| 5,715,977 | A * | 2/1998 | Goncalves | B65D 41/0471 | 222/521 |
| 5,992,656 | A * | 11/1999 | Dujardin | B29D 23/20 | 215/331 |
| 2006/0186075 | A1 * | 8/2006 | Rainey | A45D 40/0068 | 215/202 |
| 2007/0187351 | A1 * | 8/2007 | Robinson | B65D 41/0471 | 215/331 |
| 2017/0297788 | A1 | 10/2017 | Defert | | |

* cited by examiner

TUBE CLOSURE ASSEMBLY AND TUBE COMPRISING THE SAME

CROSS-REFERENCE TO RELATED APPLICATIONS

This application is a § 371 national phase entry of International Application No. PCT/EP2020/065393, filed Jun. 3, 2020, which claims priority to French Patent Application No. 1906117, filed Jun. 7, 2019.

FIELD OF THE DISCLOSURE

The present invention relates to an assembly for closing a tube and a tube comprising this assembly.

BACKGROUND

Tubes are known which are provided with a lid associated with a perforating cap comprising a punch adapted to perforate said lid.

The lid allows the product contained in the tube to be kept hermetically sealed during its storage prior to its first use, which represents a very important part of the overall life of the tube.

There are caps in which the punch is placed in the cap and protrudes from it so that it can perforate the lid when the cap is screwed onto the tube head. In order to ensure the preservation of the lid prior to the first use, a ring is arranged between the cap and a shoulder of the tube head, so as to keep the punch away from the lid when the cap is screwed onto the neck. In this position, the cap is in a so-called transport position or waiting position before first use.

To pierce and/or cut the lid, the user must first unscrew the cap, then remove the ring and finally screw the cap back on until the lid is pierced and/or cut once it has reached an end position, also known as the closing position. The number of steps is restrictive for the user, who often does not understand what the ring is for, nor does he necessarily understand that a lid must be pierced before the tube is used for the first time.

SUMMARY

It is known from document LU 88845 that a cap with a punch is held in the standby position without a removable ring. The neck comprises a housing in which a portion of thread, located on the cap, can be locked in such a position. The threaded portion is then used to screw the cap onto the neck to a position where the lid can be pierced and cut off when the tube is first used. The cap can then be screwed or unscrewed for later use or left in place when fitted with a reclosable dispensing system such as a service cap. However, this device has various drawbacks.

First of all, the placing of the cap on the neck in the waiting position is carried out according to processes operating at a very high rate. It is therefore necessary for this operation to be carried out with a high degree of reliability in order to provide satisfactory repeatability.

With the device of document LU 88845, a rib serving to snap the thread portion into the housing enabling it to be held in the standby position is produced by radial deformation of the cap. The manufacturing tolerances remain relatively high, typically greater than a tenth of a millimetre, in such a direction, which is detrimental to the ability to obtain the desired locking effect on all the caps produced, particularly in the case of demoulding with slides.

To overcome this first drawback, the present invention proposes, according to a first aspect, an assembly for closing a tube, said assembly comprising a tube head, provided with a neck, and a cap, said assembly defining a guide path, a thread and a thread portion allowing the cap to be placed on the neck by cooperation with the guide path and the thread, said assembly comprising a first and a second stop for said thread portion, said stops being angularly spaced and defining a passage between the guide path and the thread, said assembly being configured to allow axial displacement of the thread portion through the passage with a non-return effect by at least one of said stops.

According to this first aspect of the invention, the stops allowing the cap to be positioned at the desired location while preventing its return to the previous configuration, in particular a configuration in which the cap can be disengaged from the neck, are angularly positioned with respect to each other. In this way, the size of the corresponding passage is more precisely controlled, particularly in the case of a closure and a neck demoulded with slides. This provides a manufacturing process with improved repeatability.

According to this first aspect, the invention may also comprise any of the following features, taken individually or in any technically possible combination forming as many embodiments of the invention, this including with the features of the other aspects of the invention set out below:

- said tube head is further provided with a lid closing said neck,
- said cap is provided with a punch adapted to perforate said lid,
- said neck and said cap are configured to guide the cap from an initial position in which the cap is not engaged with the neck to a waiting position in which the punch is kept at a distance from said lid, in particular after the thread portion has passed through said passage, and then from said waiting position to a closing position in which said punch has perforated said lid
- said guide path allows the passage from the initial position to the waiting position and said threading allows the passage from the waiting position to the closing position,
- one of the two between the guide path and the thread induces a screwing in a clockwise direction of rotation of the cap, the other of the two between the guide path and the thread inducing a screwing in a counterclockwise direction of rotation of the cap,
- the guide path induces counterclockwise rotation of the cap and the thread induces clockwise rotation of the cap,
- the neck comprises the guide path and the thread and the cap comprises the thread portion, the first stop forms an end of said guide path,
- said assembly comprises a shoulder connecting an origin of a first thread of the thread and the first stop,
- the second stop is formed by an axial wall,
- the second stop forms the origin of a second thread of the thread,
- said assembly comprises a third stop configured to block a screwing of the cap after placing the cap on the neck,
- said third stop comprises a wall, extending transversely from a bottom wall of the thread,
- said wall extends axially partially through said thread,
- an angular extension between the second and third stop is just greater than an angular extension of the thread portion.

A further drawback of the device of LU 88845 is the torque required to successfully close the cap on first use.

Indeed, with the cap used in this document, it is necessary to simultaneously pierce the cap and compress a lid ensuring a tight closure of the cap. Such a torque may cause discomfort to the user.

To overcome this other drawback, the present invention proposes, according to a second aspect, an assembly for closing a tube, said assembly comprising a tube head provided with a neck and a lid closing said neck, said assembly further comprising a cap provided with a punch adapted to perforate said lid, said neck and said cap being configured to guide the cap on the neck to a closing position in which the cap has perforated the lid, passing through an intermediate position in which the punch has finished perforating said lid, as well as to cause a deformation of the material sealing the closure, said assembly being configured so that the passage through the intermediate position takes place prior to the deformation of the material sealing the closure.

By material deformation is meant, for example, material crushing or the like causing a seal.

According to this second aspect of the invention, by sequencing the operations corresponding on the one hand to the drilling and on the other hand to the compression of the material making it possible to seal the closure, a configuration is obtained in which the torque to be exerted is more constant throughout the placing of the cap on the neck, which is more comfortable for the user. In fact, the deformation of the material used for sealing only takes place once the drilling of the lid has been completed. In other words, during the deformation used for sealing, a cut in the lid may take place at the same time, but its drilling has already taken place. In particular, in the case of a punch provided with a plurality of teeth, all the teeth have pierced the said lid.

According to this second aspect, the invention may also comprise any of the following features, taken individually or in any technically possible combination forming as many modes of implementation of the invention, this including with the features of the other aspects of the invention set out in the foregoing or in the following:

- the cap is screwed onto the neck when passing through the intermediate position and up to the closing position,
- said neck and said cap are configured to guide the cap from an initial position in which the cap is not in engagement with the neck to a waiting position in which the punch is held at a distance from the lid, then from said waiting position to said closing position, in particular by screwing
- said cap and said neck are configured so that said intermediate position is located downstream of the waiting position in the direction in which the cap is guided towards the closure position,
- said assembly comprises a thread portion and a thread for screwing the cap onto the neck,
- said assembly comprises a stop configured to block the screwing of the cap in said waiting position, said assembly being configured so that said thread portion has passed said stop before the piercing of the lid starts,
- said assembly further comprising an anti-return stop configured to prevent the cap from leaving the closure position, said assembly being configured so that said stop is passed after passing into an intermediate position,
- the punch comprises a plurality of teeth, said intermediate position being the position occupied by the punch when all the teeth have pierced said lid,
- said punch comprises a base having an external cylindrical portion and said neck comprises an internal cylindrical portion,
- said inner and outer cylindrical portions are intended to be crushed against each other to achieve the sealing of said closure,
- said cap comprises an apex from which said punch base extends, said punch comprising an external chamfer extending said base and connected to a distal part of the punch,
- said portion of the neck against which the base of the punch is intended to crush is located in axial extension of a chamfer, located at an open end of the neck
- said distal part of the punch has an external diameter smaller than an internal diameter of the neck.

According to another drawback of the device of document LU 88845, the cap comprises a non-return stop allowing to maintain the cap in place once in the closed position. However, this stop is located in the thread used to guide the cap on the neck and the portion of the thread used to screw the cap on has to force its way over this stop. This can damage the stop and requires additional torque to be applied by the user. This stop can also give the user the impression of a hard point corresponding to the end of the stroke marking the closure of the cap when this is not yet the case. The perforation of the lid by the punch may not be completed, which will hinder the proper flow of the product contained in the tube. There is also a risk that the seal will not be completely achieved.

To overcome this other drawback, the present invention proposes, according to a third aspect, an assembly for closing a tube, the said assembly comprising a tube head provided with a neck and a lid closing the said neck, the said assembly also comprising a cap comprising a punch adapted to perforate the said lid, said neck and said cap being configured to guide the cap to a closure position in which said punch has perforated said lid, said cap comprising a lateral skirt provided with at least one notch opening radially, said neck comprising a protrusion configured to cooperate angularly with said notch to block withdrawal of the cap, once said cap is in said closure position.

According to this third aspect of the invention, the protrusion for blocking the cap in the closed position does not come into contact with the shapes used to guide the cap to its closed position. Instead, it is located at a distance from and cooperates with a specific shape, namely the notch provided in the cap to effect the desired locking. In this way, damage to the shapes used to guide the cap on the neck is avoided and the correct identification of the end position is made reliable.

According to this third aspect, the invention may also comprise any of the following features, taken individually or in any technically possible combination forming as many modes of implementation of the invention, including with the features of the other aspects of the invention set out in the foregoing or in the following:

- said notch is open at a free edge of said skirt so as to impart radial resilience to the cap in the vicinity of said notch,
- said protrusion is configured to radially spread said skirt before the cap arrives in the closed position,
- said protrusion has an edge provided with an inclined portion and a straight portion, said inclined portion being configured to radially spread said cap and said straight portion being located at a part of the protrusion forming a non-return stop for the cap once in the closure position,
- said assembly comprises a thread and a thread portion configured to co-operate with said thread for screwing the cap to said closure position, said assembly is configured for said thread portion to reach said closure position by passing away from said protrusion, said protrusion extends axially from a terminal end of a lower thread of the thread, said assembly further comprises an end stop for the cap in the closed position, said assembly further comprises an end stop for the cap, in the closed position, the end stop is configured to cooperate with said thread portion, once said protrusion is engaged in one of said notches, said assembly comprises a plurality of said notches and a plurality of said thread portions, each of said thread portions being angularly located between two adjacent ones of said notches, said cap comprises a service cap.

According to another drawback of the device of LU 88845, the punch protrudes into the interior volume of the receptacle in the closure position of the cap. This limits the rate of product return. Indeed, the product located in the receptacle at the level of the punch is blocked by the latter and cannot penetrate into the neck.

To overcome this other drawback, the present invention proposes, according to a fourth aspect of the invention, an assembly for closing a tube, the said assembly comprising a tube head provided with a neck and a lid closing the said neck, the said assembly also comprising a cap provided with a punch adapted to perforate the said lid, said neck and said cap being configured to guide the cap to a closure position in which said punch has perforated said lid, said punch comprising one or more lid-cutting teeth extending from a free edge of the punch, at least one angular portion of said free edge, called the passage portion, being configured to remain in the neck in said closure position.

According to this fourth aspect of the invention, an angular portion of the punch does not penetrate the tube and therefore nothing opposes the flow of the product which can thus be more completely distributed.

According to this fourth aspect, the invention may also comprise any of the following features, taken individually or in any technically possible combination forming as many embodiments of the invention, this including with the features of the other aspects of the invention set out in the foregoing or following:

said passage portion of the free edge of the punch is flush with a lower end of the neck, said teeth are distributed over an angular portion of the punch, called the cutting portion, delimited by two of said teeth located angularly on either side of said cutting portion, said passage edge being formed by an angular portion of the punch complementary to said cutting portion said teeth have vertices that are axially offset from one another, the axial offset of the tops of the teeth is increasing in a direction of movement of the cap towards said closing position, said teeth have a substantially identical height and extend axially from an angular portion of the free edge having an axial offset from one tooth to the other said teeth have a substantially identical profile, said lid is located at the bottom of the neck, said cap is screwed onto said neck over at least part of its travel, said cap comprises a service cap.

It should also be noted that, according to another aspect, the invention concerns an assembly for closing a tube, said assembly comprising a tube head provided with a neck and a lid closing said neck, said assembly further comprising a cap provided with a punch adapted to cut said lid, said neck and said cap being configured to guide the cap to a closing position in which said punch has perforated said lid, said punch comprising a plurality of lid cutting teeth extending from a free edge of the punch, said teeth having apices axially offset from each other, said teeth having a substantially identical height and extending axially from an angular portion of the free edge having an axial offset from one tooth to the other.

According to this aspect of the invention, an axial offset of the top of the teeth is achieved without having to employ smaller and therefore more fragile teeth than others.

The invention also relates to a tube comprising a closure assembly as described above.

BRIEF DESCRIPTION OF THE DRAWINGS

Further features, purposes and advantages of the invention will be apparent from the following description, which is purely illustrative and not limiting, and which should be read in conjunction with the appended drawings, in which.

DETAILED DESCRIPTION OF THE INVENTION

Figure 1:
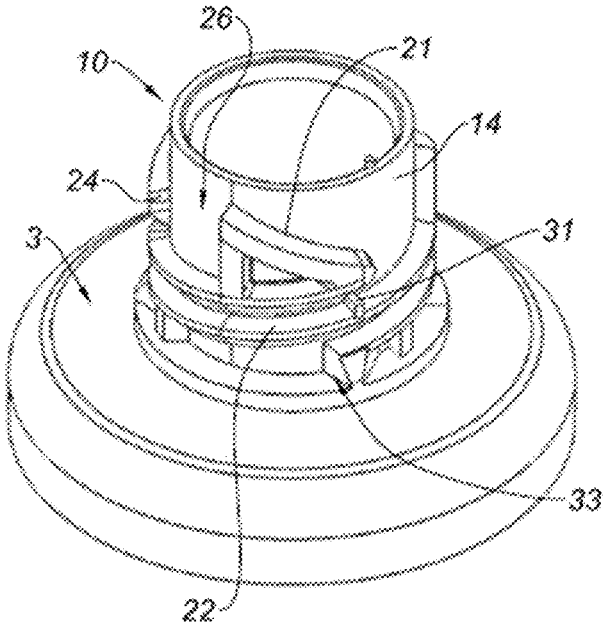
FIG. 1 is a perspective view of a tube head for a tube closure assembly according to a first embodiment of the invention, from a first viewing angle.
Figure 2:
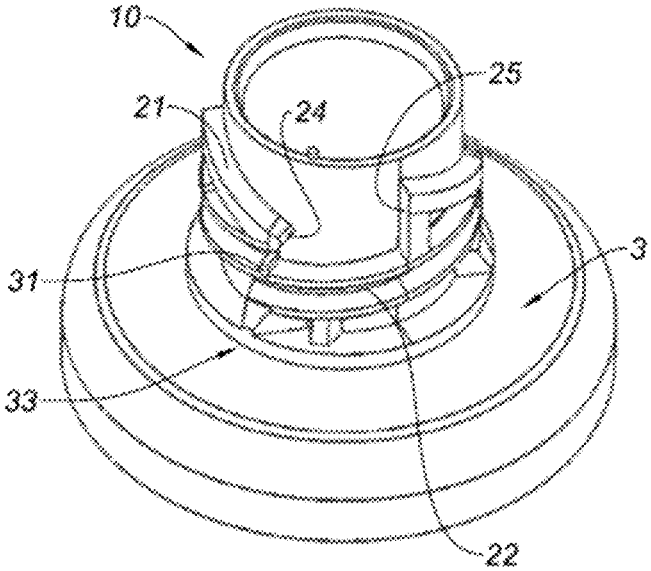
FIG. 2 is a perspective view of the tube head of FIG. 1 from another view angle.
Figure 3:
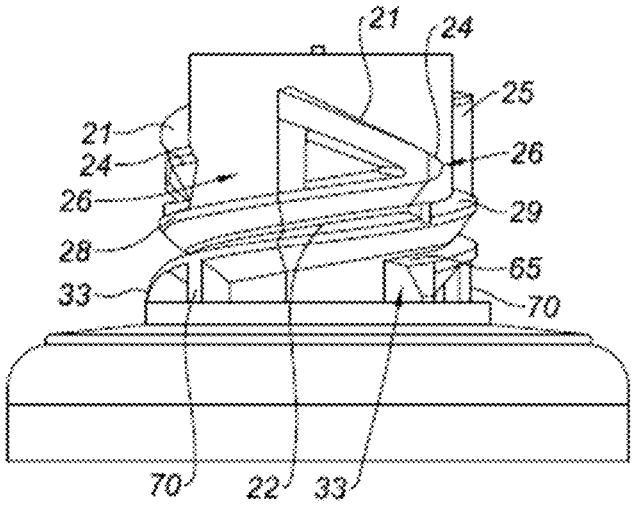
FIG. 3 is a side view of the tube head of FIG. 1 from the first viewing angle
Figure 4:
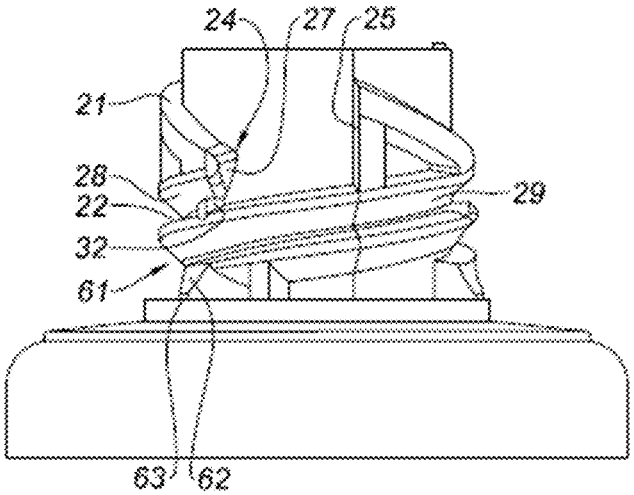
FIG. 4 is a side view of the tube head of FIG. 1 from the other view angle

As illustrated in FIGS. 1 to 19, the invention relates to an assembly for closing a tube, in particular a flexible tube.

Said assembly comprises a tube head 3 and a cap 30. The tube head 3 comprises a neck 10 and a lid 5 closing said neck 10, here at the bottom of the latter. In other words, the lid is disposed at the end of the neck in fluid communication with the tube reservoir. The cap 30 comprises a punch 7 adapted to perforate said lid 5. Said punch 7 is in particular configured to pierce and then cut said lid 5. Advantageously, said lid 5 is only partially cut so that it remains attached to the tube head 3 by a portion of material.

The neck 10 and the cap 30 extend substantially along a longitudinal axis A (see FIG. 17) passing through their centre. In the following, the term "axial" is understood to be oriented parallel to the said longitudinal axis A. The cap 30 is rotatable and/or translatable relative to said neck 10 along said longitudinal axis A.

Figure 5:
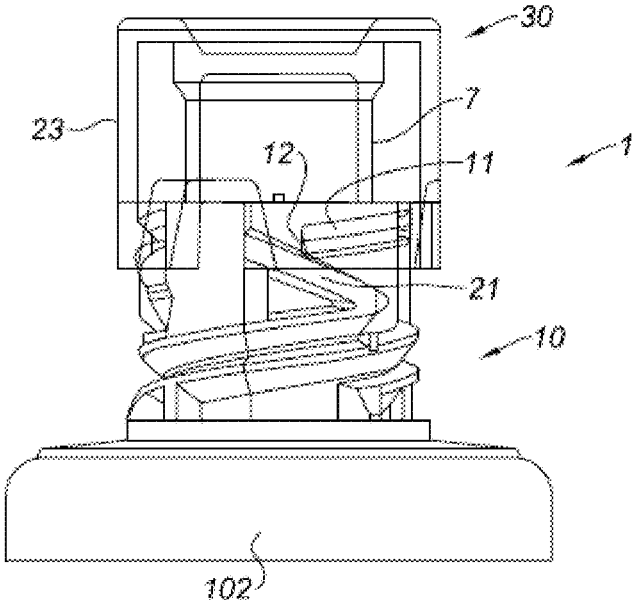
FIG. 5 is a side view of an assembly according to the invention comprising the head of FIG. 1 and a cap illustrated in transparency, according to the first angle of view, in a first position of the cap.
Figure 6:
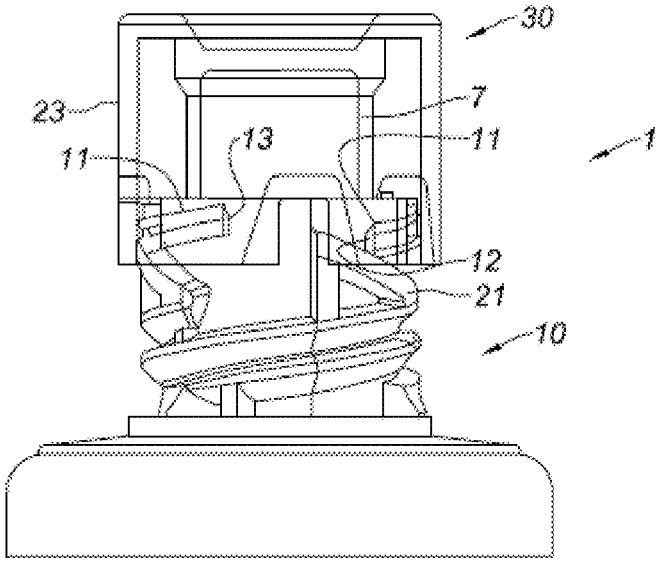
FIG. 6 is a side view of the assembly of FIG. 5 from the other viewing angle, in the first position of the cap
Figure 9:
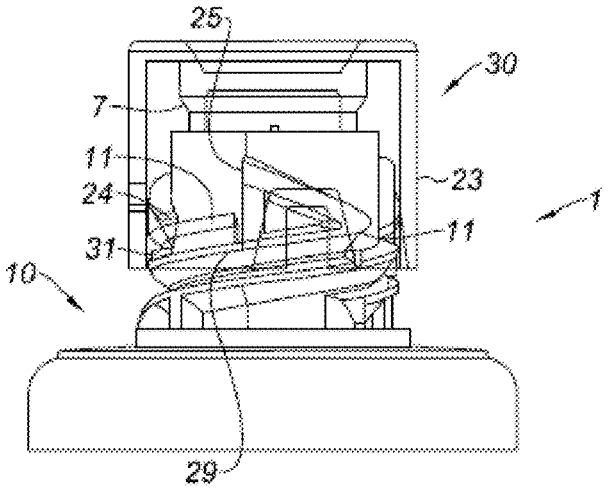
FIG. 9 is a side view of the assembly according to FIG. 5, from the first viewing angle, in a third position of the cap.
Figure 10:
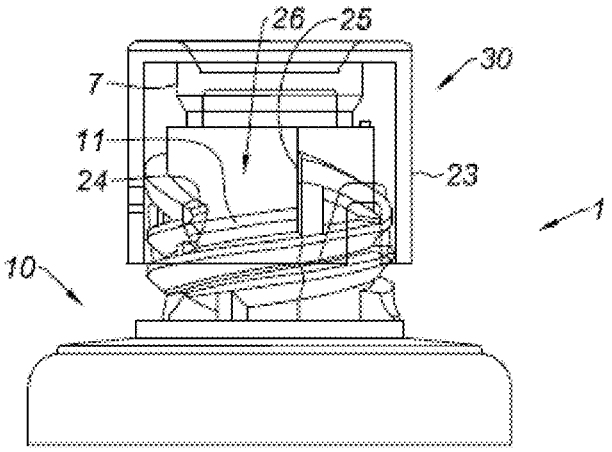
FIG. 10 is a side view of the assembly according to FIG. 5, from the other view angle, in the third position of the cap.
Figure 15:
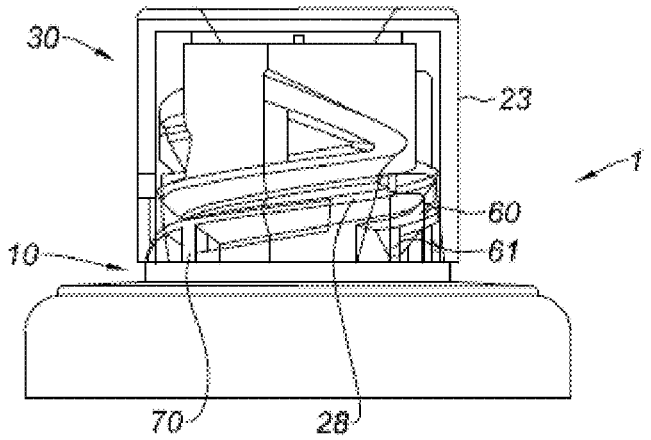
FIG. 15 is a side view of the assembly according to FIG. 5, from the first viewing angle, in a sixth position of the cap.
Figure 16:
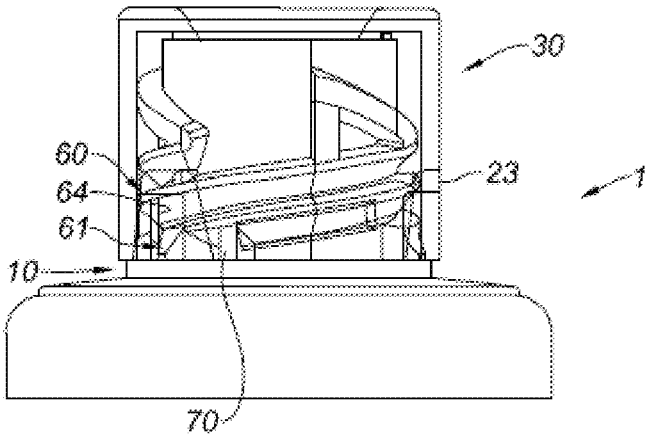
FIG. 16 is a side view of the assembly according to FIG. 5, from the other angle of view, in the sixth position of the cap.

Said neck 10 and said cap 30 are configured to allow the cap 30 to be guided, in particular from an initial position, illustrated in FIGS. 5 and 6, to a waiting position, illustrated in FIGS. 9 and 10, and then from said waiting position to a closing position, illustrated in FIGS. 15 and 16.

When the cap 30 is in its initial position, said cap 30 is not in engagement with the neck 10. Said cap 30 is in this initial position at the beginning of the movement of placing the cap 30 on the tube head 3. This placement, also known as capping, is carried out in particular on production lines. It is therefore important to allow simple, reliable and repeatable kinematics in order to limit production incidents. Advantageously, when the cap 30 is placed on the tube head 3, on production lines, the cap 30 is guided on the neck 10 along a guide path 21 along which it is simultaneously pushed towards the tube head and rotated counter-clockwise.

When the cap 30 is in the waiting position on the neck 10, the punch 7 is held at a distance from the lid 5. Said cap 30 is in this standby position at the end of the initial movement of placing the cap 30 on the tube head 3. It is in this position that the assembly is sold before filling the tube. It is also in this waiting position that the assembly is sold to the consumer, after the tube has been filled. Such an assembly ensures that it is held in the standby position without the use of an additional part such as a spacer ring.

Figure 19:
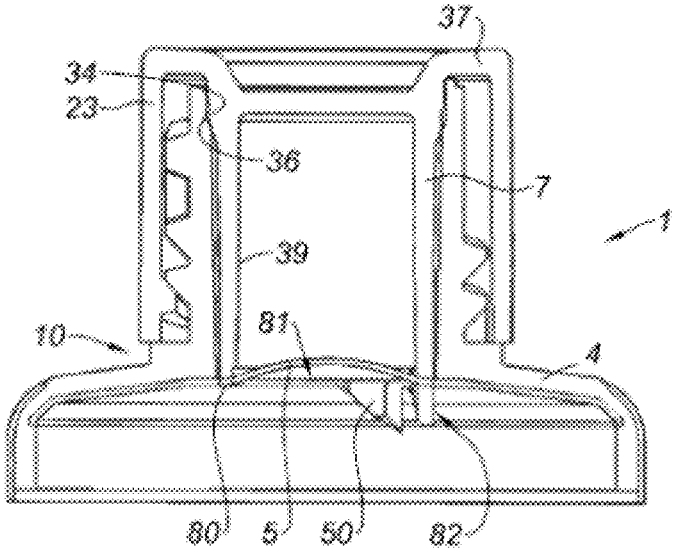
FIG. 19 is a diametrical cross-sectional view of the assembly according to FIG. 5 in the fifth position of the cap.

As illustrated in FIGS. 15, 16 and 19, when the cap 30 is in the closed position, said punch 7 has perforated said lid 5. The cap 30 then hermetically seals the tube on which the assembly is fitted. The closed position can also be described as a position of use in that the cutting of the lid 5 determines the starting point for the use of the tube on which the closure assembly 1 according to the invention is mounted. The cap 30 may in particular be intended to remain in the closed position. This is particularly the case when the punch 7 has the shape of a hollow barrel and has an opening, not illustrated, at the upper side of the cap 30. Thus, once the cap 30 is in the closed position on the neck 10, access to the internal volume of the tube on which the assembly is fitted is possible through said opening. According to an embodiment not shown, the opening of the neck 10 is closed by a cover connected to the neck 10, the cap and the cover possibly forming a service cap. In this way, the cap 30 can be held in the closed position on the neck 10 while allowing access to the internal volume of the tube and the closure of this access.

In addition to said guide path 21, said assembly comprises a thread 22 and a thread portion 11 allowing the cap 30 to be placed on the neck 10 by cooperation with the guide path 21 and the thread 22. The guide path 21 and the thread 22 are more particularly visible in FIGS. 1 to 4 while the thread portion 11 is more particularly visible, in transparency, in FIGS. 5 to 16.

As more particularly illustrated in FIGS. 5 and 6, when guiding from the initial position to the standby position, said thread portion 11 co-operates with the guide track through a front end 12 of said thread portion 11.

As more particularly illustrated in FIGS. 11 to 16, said thread portion 11 is intended to cooperate with said thread 22 by screwing.

Said cap comprises a lateral skirt 23 having an inner face at which said thread portion 11 is located. Said thread portion 11 has a substantially trapezoidal cross-section, intended to cooperate with the thread 22. Said thread portion 11 extends longitudinally along the axis A, radially inwardly of the cap 30 from the skirt 23 and angularly between its front end 12 and a rear end 13. The angular span of said thread portion is, for example, between 3° and 90°.

According to a first aspect of the invention, said assembly comprises a first stop 24 and a second stop 25 for said thread portion 11. Said stops are angularly spaced and define a passage 26 between the guide path 21 and the thread 22. Said assembly is configured to allow axial movement of the thread portion 11 through the passage 26. Furthermore, once said passage 26 is passed by said thread portion 11, at least one of said stops, here the first stop 24 is configured to prevent a return of said thread portion 11 through said passage 26. The cap 30 is then blocked on the neck 10 by snap-fit and can no longer be disengaged from the neck 10.

Such kinematics makes it possible to clearly identify the arrival in the waiting position by modifying the trajectory of the cap 30, which passes here from a movement including a rotation along the guide path 21 to an axial movement to cross the said passage 26, rather than kinematics according to which the arrival in the waiting position is done in the continuity of a screwing. Furthermore, the neck 10 has an outer wall 14 which remains smooth without ribs or grooves at said passage 26, the snap-in effect of said thread portion 11 being solely due to the angular span of said passage 26, which is chosen to be smaller than a span of said thread portion 11. The accuracy of such ribs is more easily controlled than a radial rib and may be less than a tenth of a millimetre, in particular in the case of injection moulding of said tube head 3 and/or said cap 30.

In the illustrated embodiment, said cap is in said waiting position after passing through said passage 26. In other words, said guide path 21 allows the passage from the initial position to the waiting position and said thread 22 allows the passage from the waiting position to the closing position.

Advantageously, one of the two between the guide path 21 and the thread 22 induces a screwing in a clockwise rotation direction of the cap 30, the other of the two between the guide path 21 and the thread 22 inducing a screwing in a counterclockwise rotation direction of the cap 30. Here, the guide path 21 induces a counterclockwise rotation of the cap 30 and the thread 22 induces a clockwise rotation of the cap 30.

Preferably, the neck 10 comprises the guide path 21 as well as the thread 22 while the cap 30 comprises the thread portion 11.

Here, the first stop 24 forms one end of said guide path 21. Said assembly further comprises a shoulder 27 connecting an origin of a first thread 28 of the thread 22 and the first stop 24. Thus, the origin of the first thread 28 and the first stop 24 are axially spaced apart. In particular, the first stop 24 forms a rounding joining said guide track 21 and said shoulder 27.

The second stop 25 is formed, for example, by an axial wall. The second stop 25 forms the origin of a second thread 29 of the thread 22.

Said second thread 29 advantageously forms a low axial stop when said thread portion 11 passes through said passage 26.

Preferably, said assembly comprises a third stop 31 configured to block a screwing of the cap 30 after the cap 30 has been placed on the neck 10 and more precisely, here, when said cap 30 is in the waiting position.

In other words, in the waiting position, the thread portion 11 is blocked axially upwards by the first stop 24 and downwards by the second thread 29, unscrewing by the second stop 25 and screwing by the third stop 31.

Figure 7:
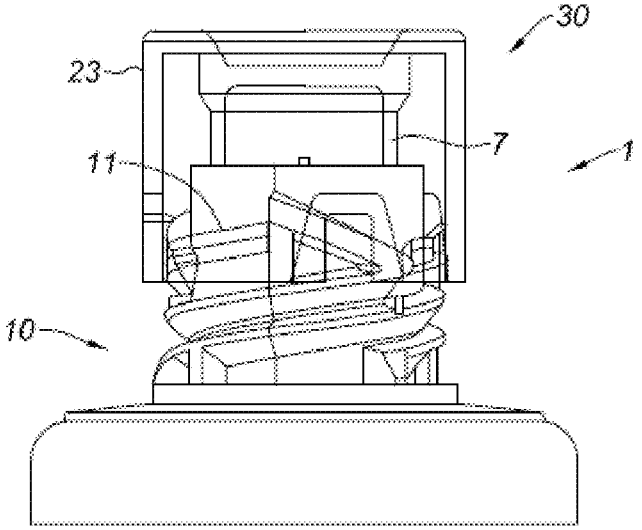
FIG. 7 is a side view of the assembly according to FIG. 5, from the first viewing angle, in a second position of the cap.
Figure 8:
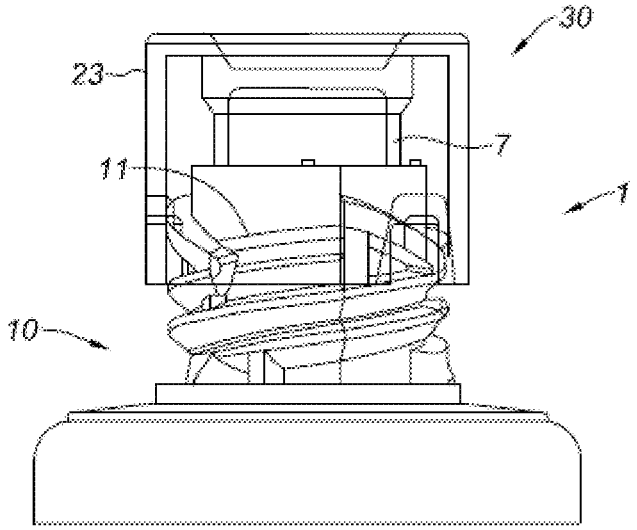
FIG. 8 is a side view of the assembly according to FIG. 5, from the other view angle, in the second position of the cap.

In FIGS. 7 and 8, the thread portion 11 is passing through the passage 26, while in FIGS. 9 and 10, said thread portion 11 is positioned between the various stops mentioned in the previous paragraph.

Said third stop 31 comprises, for example, a wall 32, extending transversely from a bottom wall of the thread 22. Said wall 32 has here a constant thickness. Said assembly has a sharp angle between the wall 32 and the second thread 29. Said wall 32 extends radially between a bottom of the thread 22 and a free distal edge and axially between said second thread 29 and a free radial edge. Preferably, said wall 32 extends axially partially through said thread 22. The axial extension of said wall 32 allows to adjust the torque required to pass said third stop 31.

Preferably, an angular extension between the second 25 and third 31 stops is just greater than an angular extension of the thread portion 11. Said third stop 31 is here positioned under said first thread 28 being slightly angularly offset from said first stop 24 in the screwing direction.

Said guide path 21 is formed, for example, by a third thread ending on the first stop 24.

Once said third stop 31 is passed, said thread portion 11 is configured to slide by screwing between the first 28 and second 29 threads.

Figure 13:
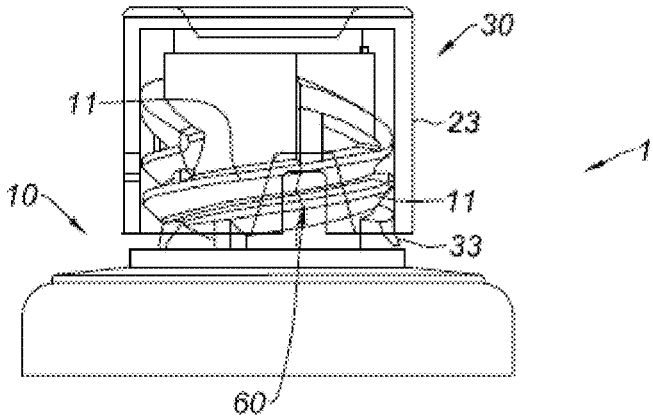
FIG. 13 is a side view of the assembly according to FIG. 5, from the first viewing angle, in a fifth position of the cap.
Figure 14:
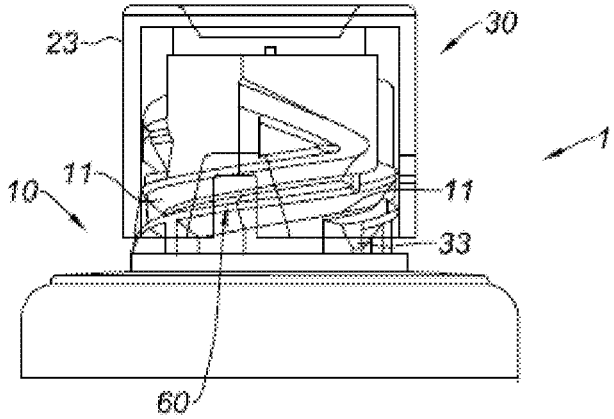
FIG. 14 is a side view of the assembly according to FIG. 5, from the other angle of view, in the fifth position of the cap.

In the further movement of the cap 30, said neck 10 and said cap 30 are configured to guide the cap 30 on the neck 10, here by screwing, to the closing position through an intermediate position, illustrated in FIGS. 13 and 14, in which the punch has finished piercing said lid 5. In the case where, as illustrated, the punch 7 comprises several teeth 50, said intermediate position is the position occupied by the punch 7 when all the teeth 50 have pierced said lid 5.

Furthermore, as already mentioned, said neck 10 and said cap 30 are configured so that guiding, here screwing, the cap 30 onto the neck 10 causes a deformation of material making the closure tight.

According to a second aspect of the invention, said assembly is configured so that the passage through the intermediate position takes place prior to the deformation of the material sealing the closure. Such a configuration is obtained by the choice of the axial dimensions of the punch 7 and neck 10. Such a sequencing avoids having to provide too much torque compared to a configuration in which the sealing would start before the end of the drilling. On the other hand, the seal can be made when the lid 5 is cut, after the end of the drilling. It has in fact been noted by the applicant that the torque required for cutting is much lower than that for drilling.

Advantageously, the said cap 30 and the said neck 10 are configured so that the said intermediate position is located downstream of the waiting position according to the direction of guidance, in particular screwing, of the cap 30 towards the closure position. In other words, in the example illustrated in relation to the first aspect of the invention, said assembly is configured so that said thread portion 11 has passed said third stop 31 before the piercing of the lid begins.

Figure 11:
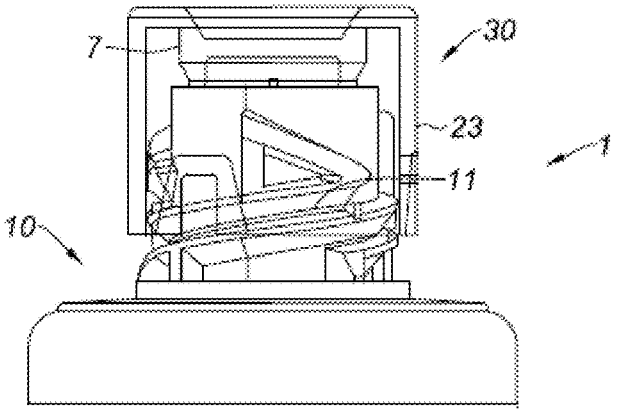
FIG. 11 is a side view of the assembly according to FIG. 5, from the first viewing angle, in a fourth position of the cap.
Figure 12:
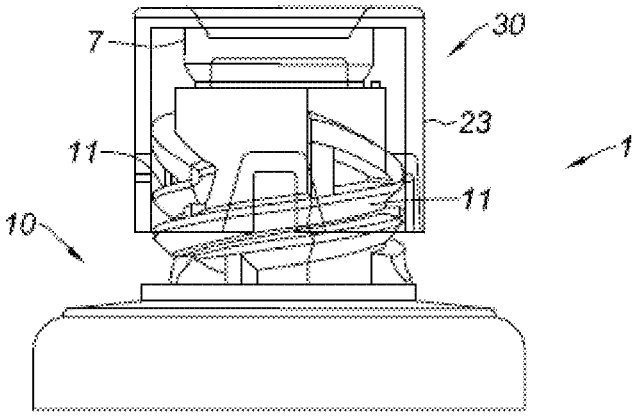
FIG. 12 is a side view of the assembly according to FIG. 5, from the other view angle, in the fourth position of the cap.
Figure 17:
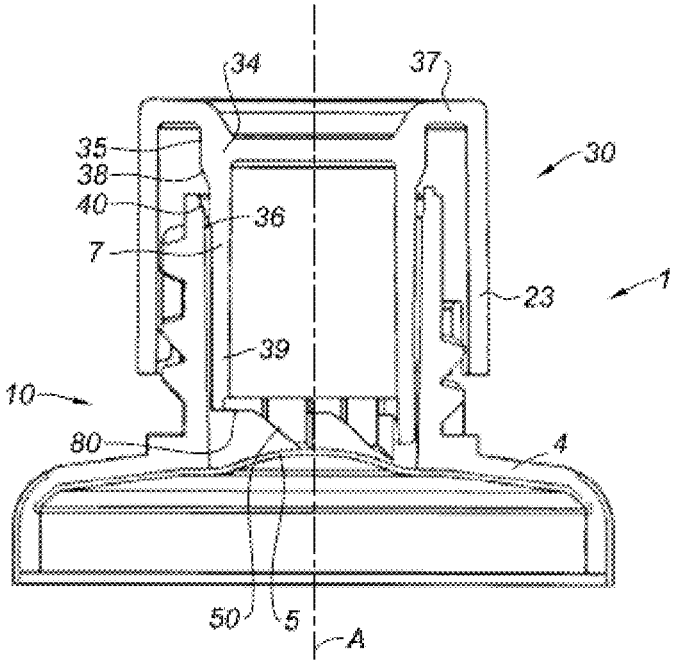
FIG. 17 is a diametrical cross-sectional view of the assembly according to FIG. 5 in the fourth position of the cap.

Taking FIGS. 11 and 12 and FIG. 17 in combination, it can be seen that the punch 7 comes into contact with the lid 5 while the thread portion 11 is still interacting with the third stop 31. However, the drilling of the lid 5 does not begin immediately after the screwing movement. The reason for this is that the lid 5 is elastic, so that it is deformed before it is pierced. Thus, drilling only begins in a position between that shown in FIGS. 11 and 12 and that shown in FIGS. 13 and 14.

Advantageously, as will be developed below in relation to the third aspect of the invention, said assembly further comprises a non-return stop 33 configured to prevent the cap 30 from moving out of the closed position. Even more advantageously, said assembly is configured so that said non-return stop 33 is passed by the cap 30 after passing to the intermediate position. In other words, as illustrated in FIGS. 13 and 14, said cap 30 does not yet cooperate with said non-return stop 33 when the cap 30 is in said intermediate position.

The sealing of the closure may be achieved in different ways. Here, it is a seal obtained by cooperation of an inner wall of the neck 10 and an outer wall of the punch 7.

Figure 18:
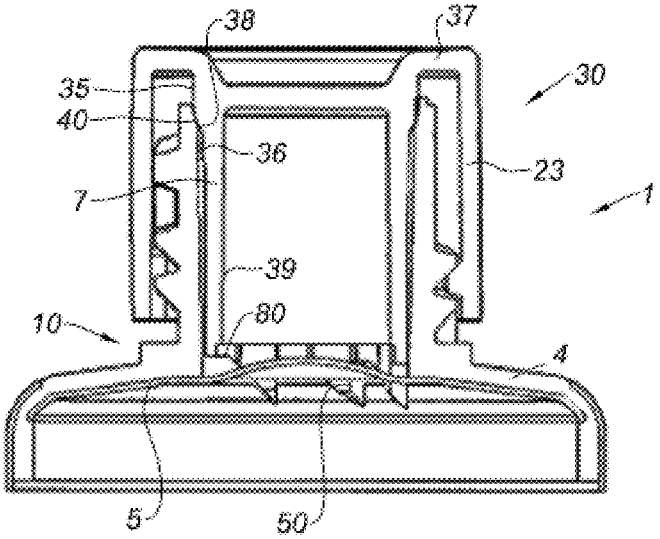
FIG. 18 is a diametrical cross-sectional view of the assembly according to FIG. 5 in the fifth position of the cap.

As illustrated in FIGS. 17 to 19, the said punch 7 comprises a base 34 with an external cylindrical portion 35 and the said neck comprises an internal cylindrical portion 36, the said internal and external cylindrical portions 36 and 35 being intended to be crushed against each other in order to seal the said closure. In this way, a cylinder-to-cylinder seal is achieved, which has the advantage of requiring less torque than that required for the compression of a seal which would be located on an upper free edge of the neck.

Said cap 30 here comprises a top 37 from which said base 34 of the punch 7 extends. Said punch 7 further comprises an external chamfer 38 extending said base 34 and connected to a distal portion 39 of the punch 7. Said neck 10 comprises at its externally open end an internal chamfer 40 axially extended by said portion 36 of the neck 10 against which the base 34 of the punch 7 is intended to be crushed.

In FIG. 17, upstream of the intermediate position, according to the screwing direction of the cap 30, it can be seen that the chamfer 38 of the punch is axially at a distance from the chamfer 40 of the neck. In FIG. 18, in the said intermediate position, the chamfer 38 of the punch has just come to rest against the chamfer 40 of the neck. In FIG. 19, in the closed position, a compression of material has occurred between the base 34 of the punch and the corresponding portion 36 of the neck 10.

Advantageously, in order to limit the necessary torque, said distal portion 39 of the punch has an external diameter smaller than an internal diameter of the neck 10.

According to a third aspect of the invention, the lateral skirt 23 is provided with at least one notch 60 opening radially and said neck 10 comprises a protrusion 61 configured to cooperate angularly with said notch 60 to block a withdrawal of the cap 30, once said cap is in said closure position. Said protrusion 61 forms the aforementioned non-return stop 33.

Such a non-return stop 33 has the advantage of not being located in the thread 22. It is therefore not likely to be damaged by the thread portion 11 when the latter moves to the closed position. In other words, in the illustrated embodiment, said thread portion 11 reaches said closing position by passing away from said protrusion 61.

Preferably, said notch 60 is open at a free edge of said skirt 23 so as to give radial resilience to the cap 30 in the vicinity of said notch 60. Such resilience has many advantages. First of all, it limits the torque required to reach the closed position by overcoming said non-return stop 33. In addition, it facilitates an axial demoulding of the thread portion 11. The notch 60 is, for example, substantially rectangular.

Advantageously, said protrusion 61 is configured to radially spread said skirt 23 before arrival of the cap 30 in the closed position. For this purpose, the said protrusion has an edge provided with an inclined portion 62 and a straight portion 63. Said straight portion 63 axially extends the inclined portion 62 towards a base of the neck 10. Said inclined portion 62 is configured to radially spread said cap 30 by pressing on a free edge of said skirt 23 before the cap 30 arrives in the closed position. Said straight portion 63 is located at a part of the protrusion 61 forming the non-return stop 33 for the cap 30 once in the closed position. More precisely, the notch 60 has an axial edge 64 bearing against a flank of said protrusion 61, the latter forming said non-return stop 33.

The protrusion 61 is formed, for example, by a wall extending radially from the outer wall 14 of the neck. Said wall has an upper free edge 65 terminating the second thread 29. Said protrusion 61 extends axially from the terminal end 65 of said second thread 29, here forming a lower thread of the thread 22, to the base of the neck 10. Said non-return stop 33 is intended to cooperate with the rear end 13 of the thread portion 11.

Advantageously, said assembly further comprises an end stop 70, in particular an angular stop, for the cap 30, in the closed position. Said end stop 70 is configured to cooperate with said thread portion 11, once said protrusion 61 is engaged in said notch 60. Said end stop 70 is intended to cooperate with the front end 12 of the thread portion 11. Said end stop 70 extends here axially between the first thread 28 and the base of the neck.

In the illustrated embodiment, said assembly comprises a plurality of said thread portions 11 and a corresponding plurality of said threads 22, in this case three, spaced at 120°. Said assembly further comprises a plurality of said notches 60 and a corresponding plurality of said protrusions 61, in this case three, each of said thread portions 11 being angularly located between two neighbours of said protrusions 61. Said side skirt 23 thereby has flaps having good radial flexibility between said notches 60, said thread portions being located at said flaps.

In this configuration with several threads 22, the first thread 28 of one of the threads forms the second thread 29 of the adjacent thread 22.

At the top, the second stops 25 extend axially between an origin of the third thread forming the guide path 21 associated with one of the threads 22 and the second thread 29 of the adjacent thread 22 in a clockwise direction.

At the bottom, the end stop 70 of one of the threads 22 is located angularly, clockwise, just upstream of the protrusion 61 of the counterclockwise adjacent thread 22. The first thread 28 of one of the threads 22 continues into an end portion of the second thread 29 of the counterclockwise adjacent thread 22.

As illustrated in FIGS. 17 to 20, said tooth or teeth 50 are advantageously configured to pierce and then cut said lid 5. Said tooth or teeth 50 extend from a free edge 80 of the punch 7.

According to a fourth aspect of the invention, at least one angular portion of said free edge 80, referred to as the passage portion 81, is configured to remain in the neck 10 in said closing position as is more particularly apparent from FIG. 19. Such a configuration improves the rate of restitution of the product contained in the tube by allowing a fraction of the product located in the vicinity of a shoulder 4 of the tube head 3 to flow into the neck 10 at the level of said passage portion 81. Advantageously, said passage portion 81 is flush with a lower end of the neck 10 opening into the interior volume of the tube.

Here, the said teeth 50 are distributed over an angular portion of the punch 7, known as the cutting portion 82, delimited by two of the said teeth 50 located angularly on either side of the said cutting portion 82. Said passage portion 81 is formed by an angular portion of the punch complementary to said cutting portion 82.

Figure 20:
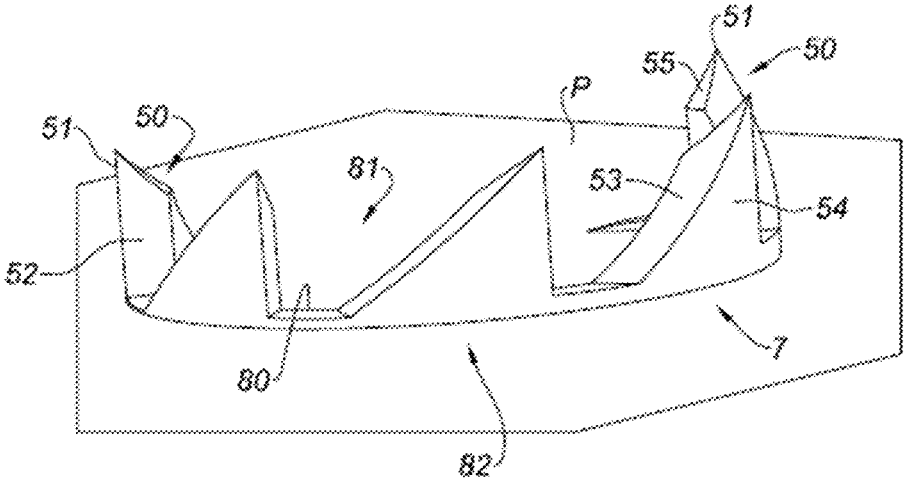
FIG. 20 is a perspective view of a distal edge of a punch of the cap of the assembly of FIG. 5, the orientation of the cap having been reversed from the previous figures.

As is better illustrated in FIG. 20 where a fictitious plane P extending orthogonally to said longitudinal axis A has been shown, said teeth 50 have vertices 51 axially offset from each other. Such a configuration makes it possible to limit the screwing torque by ensuring that the teeth 50 pierce the lid 5 successively. The axial offset of the tops of the teeth 50 increases, in particular regularly, and even more particularly linearly, in a direction of displacement of the cap 30 towards the said closed position, in other words, here, according to the screwing direction or clockwise direction (which corresponds to an anti-clockwise direction in FIG. 20 since the latter is reversed). Thus, the tooth 50 located at a terminal end of the cutting portion 82 in the clockwise direction (counterclockwise in FIG. 20) has the most protruding apex and meets the lid 5 first.

According to a fifth aspect of the invention, said teeth 50 have a substantially identical height and extend axially from an angular portion of the free edge of the punch 7 having an axial offset from one tooth 50 to the other. For this purpose, here, said free edge, in said cutting portion 82, is in the form of a ramp of increasing height in a clockwise direction (counterclockwise in FIG. 20). Such an identical height of the teeth makes it possible to limit their risk of breakage compared to a configuration in which teeth of too small a size would be encountered.

As illustrated, said teeth 50 preferably have a substantially identical profile. This is, for example, a profile with a leading edge 52 extending substantially axially between said free edge 80 and each apex 51 and a return edge 53 extending at an angle between each apex 51 and said free edge 80. Said peaks 51 are here formed at the junction of the leading edge 52, the return edge 53, an outer flank 54 of the tooth and an inclined surface 55 formed in the thickness of the teeth 50.

In addition to the assembly shown in the preceding figures, said tube according to the invention comprises a skirt 102, partially illustrated, connected to said tube head 3.

The invention claimed is:

1. An assembly for closing a tube, said assembly comprising:

a tube head provided with a neck and a lid closing said neck;

a cap comprising a punch adapted to perforate said lid, said neck and said cap being configured to guide the cap to a closing position in which said punch has perforated said lid, said cap comprising a lateral skirt provided with at least one notch opening radially, said neck comprising a protrusion configured to cooperate angularly with said notch by fitting into said notch to block withdrawal of the cap, once said cap is in said closing position, and the assembly further comprising a thread and at least one thread portion configured to cooperate with said thread for screwing the cap into said closing position; wherein said protrusion extends axially from a terminal end of a lower thread of the thread.

2. The assembly according to claim 1, wherein said notch is open to a free edge of said skirt so as to impart radial resilience to the cap in the vicinity of said notch.

3. The assembly according to claim 1, wherein said protrusion is configured to radially spread said skirt prior to arrival of the cap in the closing position.

4. The assembly according to claim 1, wherein said protrusion has an edge provided with an inclined portion and a straight portion, said inclined portion being configured to radially spread said cap and said straight portion being located at the level of a part of the protrusion forming a non-return stop for the cap once in the closing position.

5. The assembly according to claim 1, wherein said thread portion reaches said closing position by passing away from said protrusion.

6. The assembly according to claim 1, further comprising an end stop for the cap, in the closing position.

7. The assembly according to claim 6, wherein the end stop is configured to cooperate with said thread portion, once said protrusion is engaged in one of said notches.

8. The assembly according to claim 1, further comprising a plurality of said notches and a plurality of said thread portions, each of the thread portions being angularly located between two adjacent ones of said notches.

9. The assembly according to claim 1, wherein said cap comprises a service cap.

10. A tube comprising a closure assembly comprising:

a tube head provided with a neck and a lid closing said neck;

a cap comprising a punch adapted to perforate said lid, said neck and said cap being configured to guide the cap to a closing position in which said punch has perforated said lid, said cap comprising a lateral skirt provided with at least one notch opening radially, said neck comprising a protrusion configured to cooperate angularly with said notch by fitting into said notch to block withdrawal of the cap, once said cap is in said closing position, and the assembly further comprising a thread and at least one thread portion configured to cooperate with said thread for screwing the cap into said closing position; wherein said protrusion extends axially from a terminal end of a lower thread of the thread.

* * * * *